US011721901B2

(12) United States Patent
Chiu et al.

(10) Patent No.: US 11,721,901 B2
(45) Date of Patent: Aug. 8, 2023

(54) RADIO FREQUENCY COMMUNICATION DEVICE AND ITS USE FOR A TRANSPORTATION SYSTEM

(71) Applicant: Logistics and Supply Chain MultiTech R&D Centre Limited, Pok Fu Lam (HK)

(72) Inventors: Leung Chiu, Pok Fu Lam (HK); Jing Jung Tang, Pok Fu Lam (HK)

(73) Assignee: Logistics and Supply Chain MultiTech R&D Centre Limited, Pok Fu Lam (HK)

( * ) Notice: Subject to any disclaimer, the term of this patent is extended or adjusted under 35 U.S.C. 154(b) by 207 days.

(21) Appl. No.: 17/139,046

(22) Filed: Dec. 31, 2020

(65) Prior Publication Data

US 2022/0209409 A1 Jun. 30, 2022

(51) Int. Cl.

| | |
|---|---|
| ***H01Q 1/22*** | (2006.01) |
| ***H01Q 7/00*** | (2006.01) |
| ***H01Q 9/28*** | (2006.01) |

(52) U.S. Cl.

CPC ..... *H01Q 7/00* (2013.01); *H01Q 1/2208* (2013.01); *H01Q 9/285* (2013.01)

(58) Field of Classification Search

CPC ..... H01Q 7/00; H01Q 1/2208; H01Q 9/285; H01Q 9/0471; H01Q 1/2225; H01Q 1/12; H01Q 1/36

See application file for complete search history.

(56) References Cited

U.S. PATENT DOCUMENTS

| | | | | |
|---|---|---|---|---|
| 2005/0168385 | A1* | 8/2005 | Baker | H01Q 1/2216 343/700 MS |
| 2021/0257746 | A1* | 8/2021 | Isom | H01Q 9/285 |
| 2021/0367343 | A1* | 11/2021 | Mak | H01Q 9/0471 |

* cited by examiner

*Primary Examiner* — Hai V Tran
*Assistant Examiner* — Michael M Bouizza
(74) *Attorney, Agent, or Firm* — Renner, Kenner, Greive, Bobak, Taylor & Weber

(57) ABSTRACT

A radio frequency communication device and its use for a transportation system. The radio frequency communication device includes a supporting member, through which the device is arranged to attach to a cylindrical structure; and a conductive planar portion arranged to removably secure on the supporting member, the conductive planar portion includes a conductive loop being electrically connected in between the conductive planar portion and the supporting member, arranged to generate a radio frequency radiation; wherein the supporting member includes multiple flat portions arranged to fit the radio frequency device onto the cylindrical structure.

25 Claims, 6 Drawing Sheets

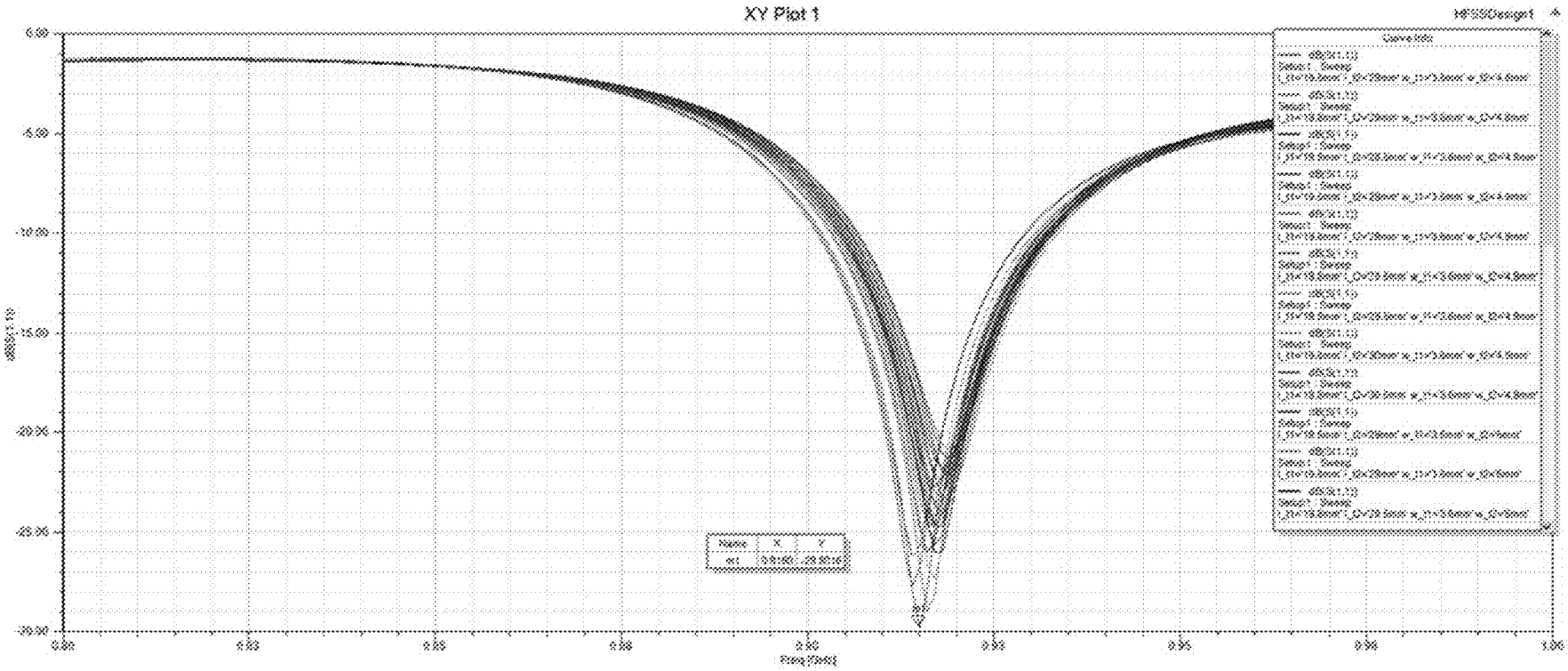
XY Plot 1
Series
Name
X
Y
Y1
0.00
0.00
0.00

RADIO FREQUENCY COMMUNICATION DEVICE AND ITS USE FOR A TRANSPORTATION SYSTEM

TECHNICAL FIELD

The present invention relates to a radio frequency communication device, although not exclusively, to a radio frequency communication device arranged to fit onto a cylindrical structure during operation.

BACKGROUND

Information may be stored in electronic devices and may be accessed by a suitable reader. For example, tagging information stored in RFID tags may be read by an RFID reader. The communication link between the tags and the reader relies on a wireless coupling, in which the tags and the reader may communicate with electromagnetic radiation or radio frequency signals.

Electronic tagging devices may be readable when it is placed within a reading range of a suitable reader. This may depend on several parameters in different systems, such as transmission power of RF signals, operation frequency, antenna designs, coupling efficiencies, obstacles between the tags and the readers, active or passive RFID technologies, etc. Antennas on the tagging device may also play an important role in the communication link between the tags and the readers.

SUMMARY OF THE INVENTION

In accordance with a first aspect of the present invention, there is provided a radio frequency communication device, comprising: a supporting member, through which the device is arranged to attach to a cylindrical structure; and a conductive planar portion arranged to removably secure on the supporting member, the conductive planar portion includes a conductive loop being electrically connected in between the conductive planar portion and the supporting member, arranged to generate a radio frequency radiation; wherein the supporting member includes multiple flat portions arranged to fit the radio frequency device onto the cylindrical structure.

In an embodiment of the first aspect, the multiple flat portions extend laterally away from the supporting member in an opposite direction, and each of the multiple flat portions is arranged to bend away from the supporting member with respect to its back surface, thereby forming a substantially curved structure that fits the cylindrical structure.

In an embodiment of the first aspect, the conductive planar portion includes a pair of lateral extensions extending away therefrom in an opposite direction, and the pair of lateral extensions is arranged to bend away from the conductive planar portion with respect to its back surface.

In an embodiment of the first aspect, the conductive planar portion is arranged to be conductively separated from the supporting member.

In an embodiment of the first aspect, the conductive planar portion is removably secured on the supporting member by a plurality of fastening members, forming a gap in between the conductive portion and the supporting member.

In an embodiment of the first aspect, the plurality of fastening members includes at least one of a metallic screw and a plastic screw.

In an embodiment of the first aspect, the conductive planar portion further includes an aperture arranged to facilitate air flow through the gap, thereby enhancing the power of the generated radio frequency radiation and/or wind resistance of the radio frequency communication device.

In an embodiment of the first aspect, the conductive loop includes a feeder in electrical connection with a transformer having a closed-loop structure.

In an embodiment of the first aspect, the feeder includes a pair of feeding plates extending from opposite edges of the aperture into the gap.

In an embodiment of the first aspect, the pair of feeding plates are in parallel to each other and each of which are substantially perpendicular to the conductive planar portion.

In an embodiment of the first aspect, the pair of feeding plates is arranged to provide differential feeding so as to suppress cross polarization of the generated radio frequency radiation.

In an embodiment of the first aspect, the pair of feeding plates is further arranged to enhance the symmetry and/or impedance bandwidth of the generated radio frequency radiation.

In an embodiment of the first aspect, the transformer is provided on the supporting member.

In an embodiment of the first aspect, the transformer is a delay-line type balun.

In an embodiment of the first aspect, the pair of feeding plates is in electrical connection with the transformer when the conductive planar portion is removably secured on the supporting member by the plurality of fastening members.

In an embodiment of the first aspect, the generated radio frequency radiation is a directional radiation.

In an embodiment of the first aspect, the directional radiation is a horizontal 3-dB beam with an azimuth of about 60° and an elevation of about 70°

In an embodiment of the first aspect, the pair of lateral extensions has a substantially the same dimension as the conductive planar portion.

In an embodiment of the first aspect, the supporting member has a substantially the same shape as the conductive planar portion.

In an embodiment of the first aspect, the supporting member is a ground plane arranged to facilitate blockage of the generated radio frequency radiation from being directed backward.

In an embodiment of the first aspect, the supporting member further includes at least one adhesive member arranged to attach the supporting member onto the cylindrical structure.

In an embodiment of the first aspect, the cylindrical structure includes a lamp pole, a footbridge support, or a gantry leg.

In an embodiment of the first aspect, the radio frequency communication device is a microstrip patch antenna.

In an embodiment of the first aspect, the device has a thickness of less than 50 mm.

In accordance with a second aspect of the present invention, there is provided with a plurality of radio frequency communication device in accordance with the first aspect for use in a transportation system.

BRIEF DESCRIPTION OF THE DRAWINGS

Embodiments of the present invention will now be described, by way of example, with reference to the accompanying drawings in which:

FIG. 3 is a plot showing a simulated result of an impedance bandwidth of the microstrip patch antenna of FIG. 2A.

DETAILED DESCRIPTION OF THE PREFERRED EMBODIMENT

Radio frequency communication device such as an antenna has been implemented in many different areas of applications. One example may be used in tolling system in metropolis area, such as car parks, tunnel entrance/exit, etc. The inventors through their own research, trials, and experiments, devised that many of the antennas used in wireless communication devices may have a flat plane structure. Meanwhile, it is appreciated that most of the infrastructure supports such as lamppost, gantry leg, footbridge support are cylindrical in shape or having a curved surface. As a result, those antennas would be failed to adapt to/fit onto the cylindrical supports unless the antennas are provided with an external supporting member, which further making the antenna to be bulky and heavily weighted.

Accordingly, the present invention seeks to eliminate or at least to mitigate such shortcomings by providing a new or otherwise improved radio frequency communication device.

Figure 1B:
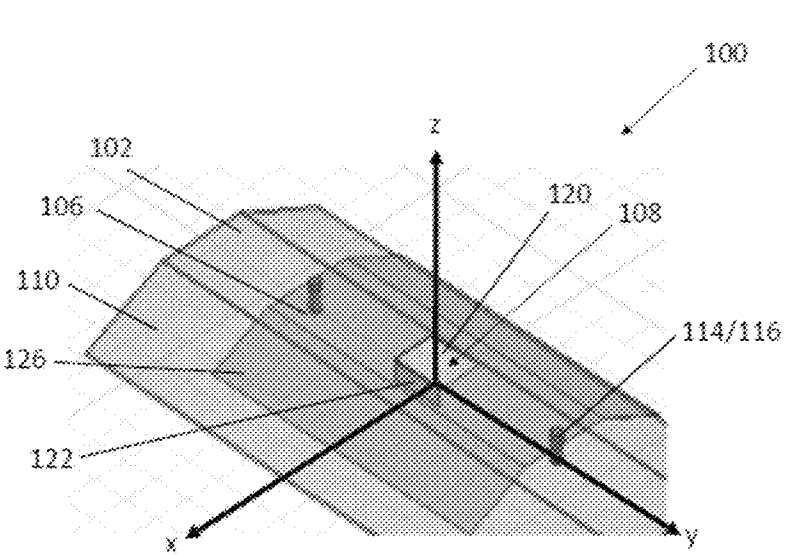
FIG. 1B is a schematic diagram showing an enlarged portion of the radio frequency communication device of FIG. 1A.
Figure 1A:
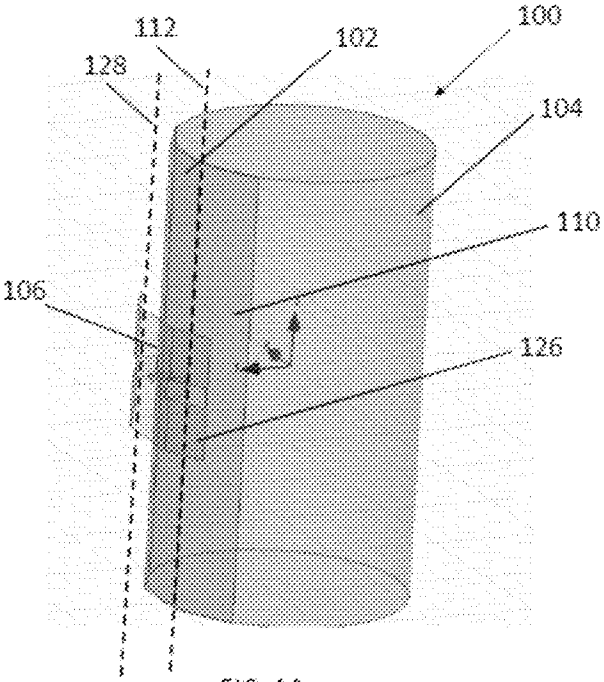
FIG. 1A is a schematic diagram showing a radio frequency communication device in accordance with one embodiment of the present invention.
Figure 1C:
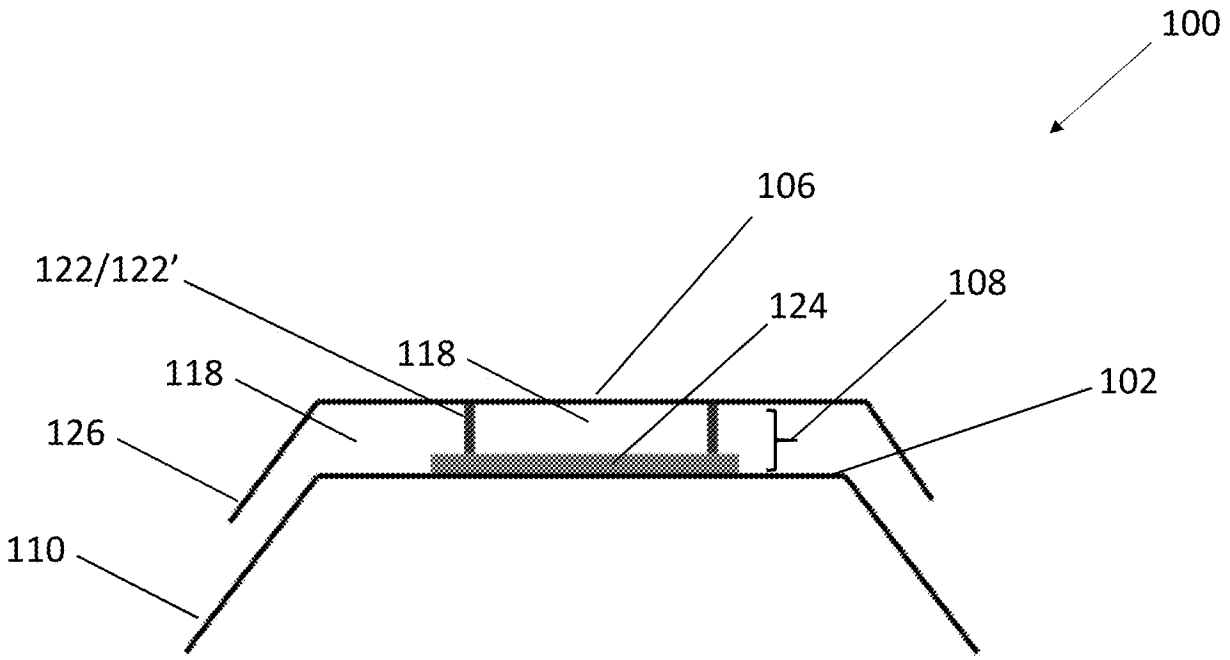
FIG. 1C is a schematic diagram showing a side view of the radio communication device of FIG. 1B.

With reference to FIGS. 1A to 1C, there is provided with a radio frequency communication device 100 in accordance with one example embodiment of the present invention. The radio frequency communication device 100 may be capable of emitting a radio frequency signal with a high directivity, wide impedance bandwidth, and horizontal polarization with low cross polarization, as well as adapting to any cylindrical or curved surfaces.

The radio communication frequency device 100 comprises a supporting member 102, through which the device 100 is arranged to attach to a cylindrical structure 104, such as but not limited to a lamp pole, a footbridge support, or a gantry leg; and a conductive planar portion 106 arranged to removably secure on the supporting member 102, the conductive planar portion 106 includes a conductive loop 108 being electrically connected in between the conductive planar portion 106 and the supporting member 102, arranged to generate a radio frequency radiation, such as a UHF RF band. In particular, the supporting member 102 may include multiple flat portions 110 arranged to fit the radio frequency device 100 onto the cylindrical structure 104. The supporting member 102 may also include at least one adhesive at its back surface for attaching the device 100 onto the cylindrical structure 104.

The multiple flat portions 110 may extend laterally away from the supporting member 102 in an opposite direction, and each of the multiple flat portions 110 is arranged to bend away from the supporting member 102 with respect to its back surface. In this way, the supporting member 102 may form a substantially "curved" structure that fits onto the surface of the cylindrical structure 104. Preferably, the multiple flat portions 110 may be of the same shape as the support member 102 for the ease of manufacture.

Optionally or additionally, the amount of the multiple flat portions 110 may be varied according a user's fitting requirements. In one example, the multiple flat portions 110 may be a part of the supporting member 102. Each of the multiple flat portions 110 may be formed by bending a portion of the supporting member 102 towards its back surface about a fold axis 112 perpendicular to the width of the supporting member 102. Thus, in this way, the user may bend the supporting member 102 along its width depending on the user's requirement to vary the number of the flat portions 110.

Referring to FIGS. 1A to 1C, the supporting member 102 may include a pair of flat portions 110 extended laterally away therefrom in an opposite direction. Each of the pair of flat portions 110 is bent away from the back surface of the supporting member 102 about a fold axis 112 so as to form a substantially curved structure that fits onto the cylindrical structure 104. In this embodiment, the supporting member 102 may further act as a ground plane arranged to facilitate blockage of the generated radio frequency radiation from being directed backward. Preferably, the supporting member 102 may be substantially larger than the conductive planar portion 106 so as to have a larger surface area for blocking any radiation generated towards the back side of the conductive planar portion 106 from being received. As such, the generated radiation may be highly directive and in one example, the radiation generated may have a directivity of −8 dBi.

The conductive planar portion 106 may co-operate with the conductive loop 108 as well as the supporting member 102 to further enhance the performance of the radio frequency communication device 100. In one example, the conductive planar portion 106 may be conductively separated from the supporting member 102. The conductive planar portion 106 may be removably secured on the supporting member 102 by a plurality of fastening members 114 provided on the surface of the supporting member 102.

Referring to FIGS. 1B and 1C, the conductive planar member 106 may be secured by at least a pair of fastening members 114 provided along the y-axis of the supporting member 102. Preferably, the fastening members 104 may include at least one of a metallic screw and a plastic screw. In this example, the pair of fastening members 104 are metallic screws. The conductive planar portion 106 may include a plurality of holes 116 that matches the position of the plurality of fastening members 114, thereby the conductive planar portion 106 may be screwed onto the supporting member 102 through those holes 116. As such, the conductive loop 108 will be sandwiched between the conductive planar portion 106 and the supporting member 102, leaving a gap 118 therebetween. In other words, the conductive planar portion 106 may be conductively connected to the supporting member 102 via the fastening members 114 while being separated from the supporting member 102 through the gap 118.

In this way, the gap 118 may be filled with surrounding air during operation. Since air has a low dielectric constant and low signal loss property, the gap 118 (filled with air) would facilitate the device 100 to have a higher gain, or in other words to generate a radio frequency radiation with higher power. It is also advantageous that the gap 118 may facilitate dissipate any wind force acting on the device by allowing the wind to pass through the gap 118, thereby enhancing the wind resistance of the device 100.

The conductive planar portion 106 may further includes an aperture 120 arranged to facilitate air flow through the gap 118, thereby enhancing the power of the generated radio frequency radiation and/or wind resistance of the device 100. Referring to FIGS. 1B and 1C, the aperture 120 may be in electrical connection with the conductive loop 118, and the conductive loop 118 may have a feeder 122 in electrical connection with a transformer 124 having a close-loop structure, such as a delay-line type balun. The feeder 122 may include a pair of feeding plates 122' extending from the back surface of the conductive planar portion 106. Preferably, the pair of feeding plates 122' may be extended from the opposite edges of the aperture 120 into the gap 118. In one example, the pair of feeding plates 122' may be in electrical connection with the transformer 124 when the conductive planar portion 106 is removably secured on the supporting member 102 by the plurality of fastening members 114.

As shown in FIGS. 1B and 1C, the pair of feeding plates 122' may be in parallel to each other and each of them are substantially perpendicular to the conductive planar portion 106. In this example, the transformer 124 may be provided on the supporting member 102 and therefore the pair of feeding plates 122' may be electrically connected to the transformer 124 when the conductive planar portion 106 is screwed onto the supporting member 102. In other words, the pair of feeding plates 122' may be considered as being forced to electrically contact with the transformer 124 by a mechanical force generated from the fastening members 114. The aperture 120 may therefore be considered as in fluidic communication with the gap 118 by air, facilitating air flowing along/passing through the gap 118. As such, on the one hand, the device 100 may capture air into the gap 118 more easily when wind is available, which is advantageous in enhancing the power of the generated radio frequency radiation as mentioned above; on the other hand, such fluidic communication may provide a passage for wind coming from the front side of the device 100 (e.g. from the direction along the y-axis as shown in FIG. 1A) to leave the device 100, thereby enhancing the wind resistance of the device 100.

In addition, the parallel arrangement of the feeding plates 112' is particularly advantageous in providing differential feeding, thereby suppressing cross polarization of the generated radio frequency radiation, rendering the generated radiation pattern to be more symmetric. Also, the vertical shape of the feeding plates 112' contributes to enhance the impedance bandwidth of the generated radiation.

In one example, the conductive planar portion 106 may also include a pair of lateral extensions 126 extending away therefrom in an opposite direction, and the pair of lateral extensions 126 is arranged to bend away from the conductive planar portion 106 with respect to its back surface. For the ease of manufacture, preferably, the pair of lateral extensions 126 may be of the same dimension (i.e. size, and shape) as the conductive planar portion 106.

Referring to FIGS. 1A to 1C, the pair of lateral extensions 126 may be a part of the conductive planar member 106. Each of the pair of lateral extensions 126 may be formed by bending a portion of the conductive planar member 106 towards its back surface about another fold axis 128 perpendicular to the width of the conductive planar member 106 forming a substantially curved structure having a substantially the same shape as the supporting member 102. Optionally or additionally, a user may include more lateral extensions 110 by making more folds to the conductive planar member 106 about the fold axis 128 along the width of the conductive planar member 106 according to his requirement.

Based on the component arrangements mentioned above, the radio frequency radiation generated by the device 100 according to the embodiments of the present invention would be highly directional. In one example, the device 100 may be capable of generating a directional radiation of a horizontal 3-dB beam with an azimuth of about 60° and an elevation of about 70°. Such a high degree of directivity may be particularly advantageous when the device 100 is applied in a transportation system, in which it can ensure the effective read zone would fall within a dedicated area and avoid false reading from adjacent lanes.

Figure 2B:
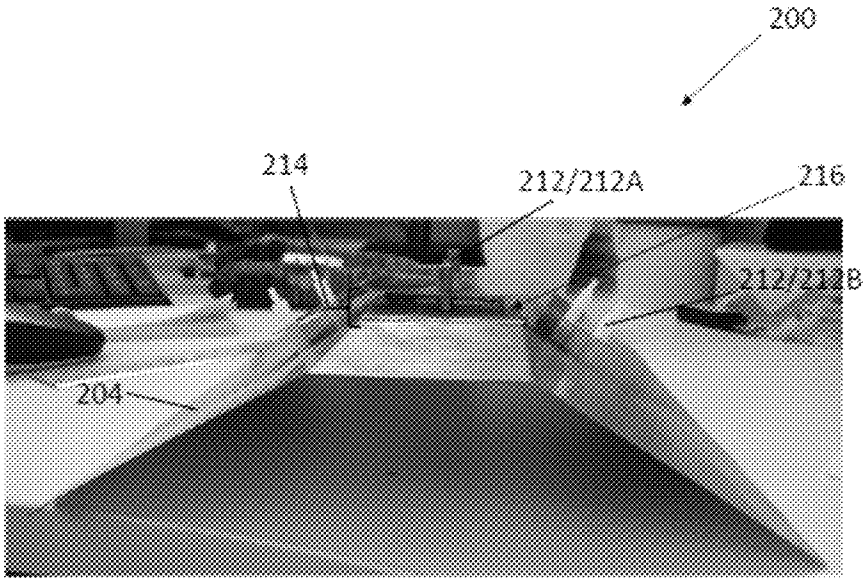
FIG. 2B is a side view of the microstrip patch antenna of FIG. 2A.
Figure 2A:
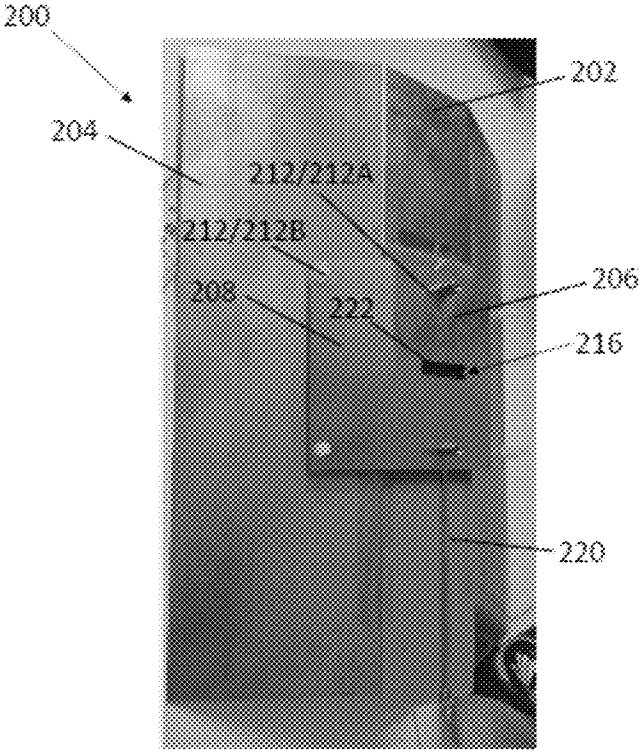
FIG. 2A is a perspective view of a microstrip patch antenna in accordance with one embodiment of the present invention.
Figure 2C:
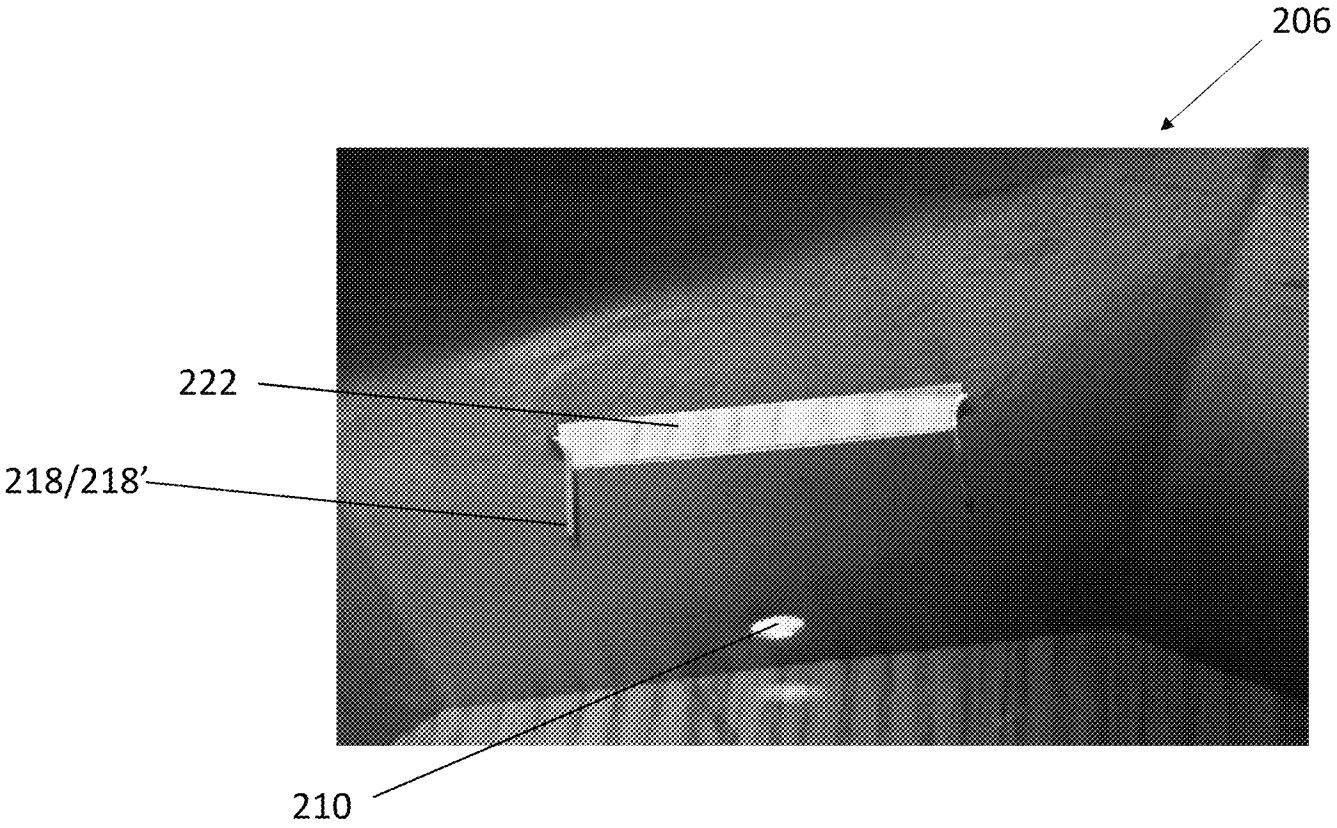
FIG. 2C is an illustration showing an enlarged portion of the back side of the conductive planar portion of the microstrip patch antenna of FIG. 2A.

With reference to FIGS. 2A to 2C, there is provided with an example embodiment of a radio frequency communication device 200. In this embodiment, the radio frequency communication device is a microstrip patch antenna 200. The antenna 200 comprises a metallic supporting member 202 having a pair of flat portions 204 of the same shape as the supporting member 202, extending away therefrom in an opposite direction. The pair of flat portions 204 are bent away from the back surface of the supporting member 202 so as to form a substantially curved structure that fits onto a cylindrical structure/surface. The supporting member 202 as well as the pair of flat portions 204 may be provided with, at their back surface, a plurality of adhesive members (not shown) such as adhesive tapes or any other coupling members known in the art that may facilitate attaching the device 200 to the cylindrical structure/surface.

On the supporting member 202, there is removably secured with a conductive planar portion 206 having a pair of lateral extensions 208 of the same shape as the conductive planar portion 206, extending away therefrom. The pair of lateral extensions 208 are bent away from the back surface of the conductive planar portion 206 so as to form a substantially curved structure that fits to the shape/profile of the supporting member 202. The conductive planar member 206 as well as the pair of lateral extensions 208 includes a plurality of holes 210 thereon, allowing it to be screwed onto the supporting member 202 via a plurality of fastening members 212. As shown in FIG. 2B, the conductive planar member is secured by a pair of metallic screws 212A whereas its pair of lateral extensions are secured by two pairs of plastic screw 212B.

As shown, the conductive planar member 206 is not closely attaching to the supporting member 202 after being secured, but leaving a gap 214 therebetween. Within the gap 214, there is provided with a conductive loop 216 being electrically connected. The conductive loop 216 includes a feeder 218 in electrical connection with a delay-line type balun 220 being fabricated on a printed circuit board (PCB). Referring to FIGS. 2A to 2C, the feeder 218 includes a pair of vertical feeding plates 218' extending in parallel, from the opposite edges of an aperture 222 of the conductive planar portion 206, and the PCB/delay-line type balun 220 is provided on the supporting member 202. As such, when the conductive planar portion 206 is screwed onto the supporting member 202, the pair of vertical feeding plates 218' will be forced to electrically contact with the PCB/balun 220 by the mechanical force provided by the screws 212.

As mentioned above, the radio frequency communication device such as the microstrip patch antenna 200 possesses several features that make the device 200 being advantageous. For example, the supporting member 202 is substantially larger than the conductive planar portion 206. It therefore provides the supporting member 202 a larger surface area for acting as a ground plane for blocking any radiation generated from the conductive loop 208 being directed backward, rendering the generated radiation more directive. In addition, the gap 214 as well as the aperture 222 are capable of facilitating air flow through the antenna 200, thereby dissipating wind force acting on the antenna 200, minimizing the damage of wind toward the antenna 200. Also, the air within the gap 214 would help to achieve a high antenna gain since air has low signal loss property and a low dielectric constant.

Furthermore, on the one hand, the pair of vertical feeding plates 218' are capable of providing differential feeding which can suppress cross polarization of the generated radiation. Such feeding mode also makes the generated radiation to have a more symmetric pattern. On the other hand, the vertical configuration of the feeding plates 218' may enhance the impedance bandwidth of the generated radiation.

For example, referring to FIG. 3, the stimulation results indicate that the antenna 200 is capable of generating a RFID signal with a bandwidth of 920 MHz to 925 MHz, with an average bandwidth of 915 MHz. Alternatively, the dimensions of the components of the antenna may be modified based on different applications of the antenna, such that it may be used in all wireless communication systems, which may require the antenna to operate in different frequency bands and/or ranges.

Figure 4:
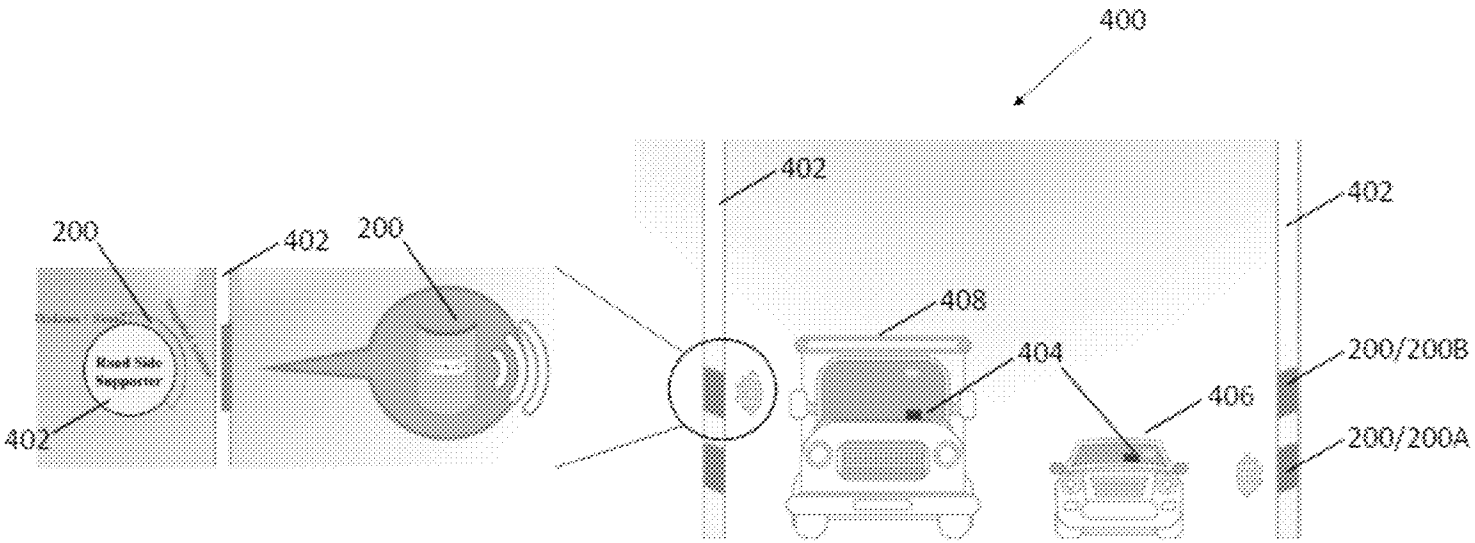
FIG. 4 is an illustration showing a transportation system using a plurality of the microstrip patch antennas of FIG. 2A.

With reference to FIG. 4, there is provided with an example embodiment of the antenna 200 being used in a transportation system 400. In this example, the transportation system may be a tolling system 400 for charging vehicles passing by. In the system, the antenna 200 may be attached to a lamp pole 402 and arranged to communicate with an RFID tag 404 provided on the vehicles for operation.

The antenna 200 may have a thickness of less than 50 mm, such that it may appear to be "invisible" (i.e. unlikely to be recognized) to any pedestrians or vehicles passing by the lamp pole 402. This substantially thin configuration may also render the antenna 200 less susceptible to strong wind. As mentioned, the antenna 200 is capable of generating radio frequency radiation with high directivity such as a horizontal 3-dB beam with an azimuth of about 60° and an elevation of about 70°, thus in operation, it is preferred that a plurality of the antennas 200 may be applied to the lamp pole 402 so as to fit with communicating RFID tags 404 provided in vehicles of different heights.

For example, referring to FIG. 4, each of the lamp poles 402 is attached with two antennas 200, one at a lower position and the other one at a higher position of the lamp pole. Preferably, the lower antenna 200A may be at a position that allows it to effectively communicate with the RFID tag provided on a windshield of a private car 406 or any public transport vehicles having a height similar to a private car. Similarly, the higher antenna 200B may be at a position that allows it to effectively communicate with the RFID tag provided on the windshield of a truck 408 or any public transport vehicles with similar height. As such, each of the antennas 200 would have its own effective communication zone within a dedicated area, thereby minimizing any undesired false reading from adjacent lanes.

In operation, when the vehicle such as the private car 406 comes proximately to the lamp pole 402, the lower antenna 200A may communicate with the RFID tag 404 (such as an RFID card) that may store payment account information of the private car driver, and therefore allowing the driver to pay charges/fees automatically without stopping the car. Similarly, in case the vehicle is the truck 408, it would be the higher antenna 200B instead of the lower antenna 200A in communication with the RFID card 404 provided in the truck 408 for completing the transaction.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A radio frequency communication device, comprising:

a supporting member, through which the device is arranged to attach to a cylindrical structure; and a conductive planar portion arranged to removably secure on the supporting member, the conductive planar portion includes a conductive loop being electrically connected in between the conductive planar portion and the supporting member, the conductive planar portion arranged to generate a radio frequency radiation;

wherein the supporting member includes multiple flat portions arranged to fit the radio frequency device onto the cylindrical structure, the feeder includes a pair of vertical feeding plates extending, in parallel, from the conductive planar portion, and a transformer is provided on the supporting member, such that when the conductive planar portion is secured to the supporting member by fasteners, the pair of vertical feeding plates are forced to electrically contact with the transformer by mechanical force provided by the fasteners.

2. The radio frequency communication device according claim 1, wherein the multiple flat portions extend laterally away from the supporting member in an opposite direction, and each of the multiple flat portions is arranged to bend away from the supporting member with respect to its back surface, thereby forming a substantially curved structure that fits the cylindrical structure.

3. The radio frequency communication device according to claim 1, wherein the conductive planar portion includes a pair of lateral extensions extending away therefrom in an opposite direction, and the pair of lateral extensions is arranged to bend away from the conductive planar portion with respect to its back surface.

4. The radio frequency communication device according to claim 3, wherein the pair of lateral extensions has a substantially the same dimension as the conductive planar portion.

5. The radio frequency communication device according to claim 1, wherein the conductive planar portion is arranged to be conductively separated from the supporting member.

6. The radio frequency communication device according to claim 5, wherein the conductive planar portion is removably secured on the supporting member by a plurality of fastening members, forming a gap in between the conductive portion and the supporting member.

7. The radio frequency communication device according to claim 6, wherein the plurality of fastening members includes at least one of a metallic screw and a plastic screw.

8. The radio frequency communication device according to claim 1, wherein the generated radio frequency radiation is a directional radiation.

9. The radio frequency communication device according to claim 8, wherein the directional radiation is a horizontal 3-dB beam with an azimuth of about 60° and an elevation of about 70°.

10. The radio frequency communication device according to claim 8, wherein the cylindrical structure includes a lamp pole, a footbridge support, or a gantry leg.

11. The radio frequency communication device according to claim 1, wherein the supporting member has a substantially the same shape as the conductive planar portion.

12. The radio frequency communication device according to claim 1, wherein the supporting member is a ground plane arranged to facilitate blockage of the generated radio frequency radiation from being directed backward.

13. The radio frequency communication device according to claim 1, wherein the supporting member further includes at least one adhesive member arranged to attach the supporting member onto the cylindrical structure.

14. The radio frequency communication device according to claim 1, wherein the radio frequency communication device is a microstrip patch antenna.

15. The radio frequency communication device according to claim 1, wherein the device has a thickness of less than 50 mm.

16. A plurality of radio frequency communication device in accordance with claim 1 for use in a transportation system.

17. A radio frequency communication device comprising:

a supporting member, through which the device is arranged to attach to a cylindrical structure; and a conductive planar portion arranged to removably secure on the supporting member, the conductive planar portion includes a conductive loop being electrically connected in between the conductive planar portion and the supporting member, the conductive planar portion arranged to generate a radio frequency radiation;

wherein the supporting member includes multiple flat portions arranged to fit the radio frequency device onto the cylindrical structure, and the conductive planar portion further includes an aperture arranged on a surface of the conductive planar portion to facilitate air flow through the aperture and the gap, thereby enhancing the power of the generated radio frequency radiation and/or wind resistance of the radio frequency communication device.

18. The radio frequency communication device according to claim 17, wherein the conductive loop includes a feeder in electrical connection with a transformer having a closed-loop structure.

19. The radio frequency communication device according to claim 18, wherein the feeder includes a pair of feeding plates extending from opposite edges of the aperture into the gap.

20. The radio frequency communication device according to claim 19, wherein the pair of feeding plates are in parallel to each other and each of which are substantially perpendicular to the conductive planar portion.

21. The radio frequency communication device according to claim 19, wherein the pair of feeding plates is arranged to provide differential feeding so as to suppress cross polarization of the generated radio frequency radiation.

22. The radio frequency communication device according to claim 19, wherein the pair of feeding plates is further arranged to enhance the symmetry and/or impedance bandwidth of the generated radio frequency radiation.

23. The radio frequency communication device according to claim 19, wherein the pair of feeding plates is in electrical connection with the transformer when the conductive planar portion is removably secured on the supporting member by the plurality of fastening members.

24. The radio frequency communication device according to claim 18, wherein the transformer is provided on the supporting member.

25. The radio frequency communication device according to claim 18, wherein the transformer is a delay-line type balun.

* * * * *